United States Patent [19]

Girnus, Sr.

[11] 3,945,159

[45] Mar. 23, 1976

[54] ANTI-THEFT VEHICLE SHELTER

[76] Inventor: Ronald Carl Girnus, Sr., 3718 - 173rd Court, Hammond, Ind. 46324

[22] Filed: Oct. 2, 1974

[21] Appl. No.: 511,436

[52] U.S. Cl. ..... 52/66; 135/5 A; 248/203

[51] Int. Cl.[2] ..... E04B 7/16

[58] Field of Search ..... 135/5 R, 5 A; 52/64, 66, 52/72; 70/158, 159; 248/203, 228

[56] References Cited

UNITED STATES PATENTS

| | | | |
|---|---|---|---|
| 2,740,997 | 4/1956 | Gipslis | 52/66 |
| 2,930,387 | 3/1960 | Streich et al. | 135/6 |
| 3,009,211 | 11/1961 | Hausen et al. | 52/66 |
| 3,138,260 | 6/1964 | Tedrick | 248/203 |
| 3,180,510 | 4/1965 | Molley | 52/64 |
| 3,343,311 | 9/1967 | Wright | 52/66 |
| 3,797,178 | 3/1974 | Mule | 52/66 |
| 3,861,092 | 1/1975 | Dale et al. | 52/66 |

*Primary Examiner*—Andrew V. Kundrat
*Assistant Examiner*—Conrad L. Berman
*Attorney, Agent, or Firm*—Sabin C. Bronson

[57] ABSTRACT

A large rigid plastic bubble or pod is provided for removable and tilting attachment to a frame on which a motorcycle, bicycle, snowmobile or other small vehicle is positioned, the frame being removably anchored to a curbstone of a suitable parking space adjacent an apartment house or building, to provide a temporary garage and to protect the vehicle from the elements, pilfering or theft.

2 Claims, 7 Drawing Figures

FIG. 1
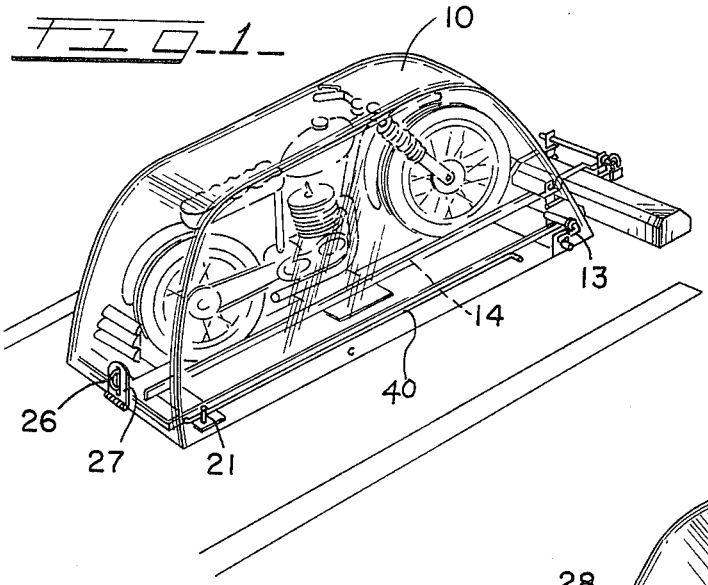
FIG. 2
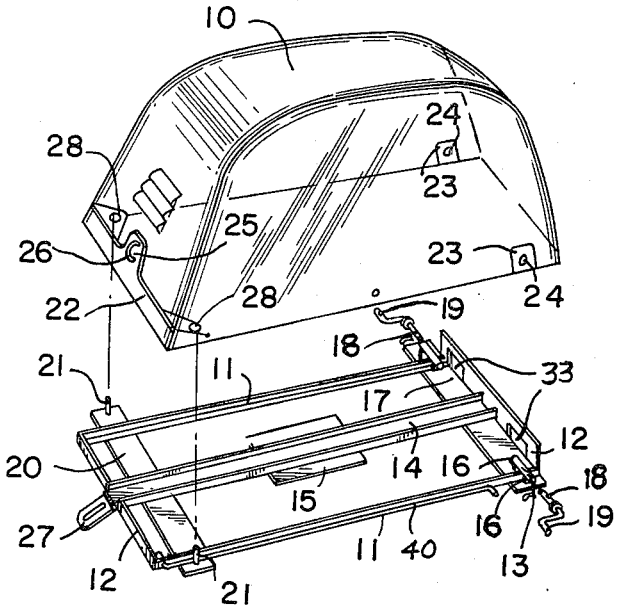
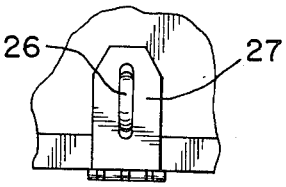
FIG. 4
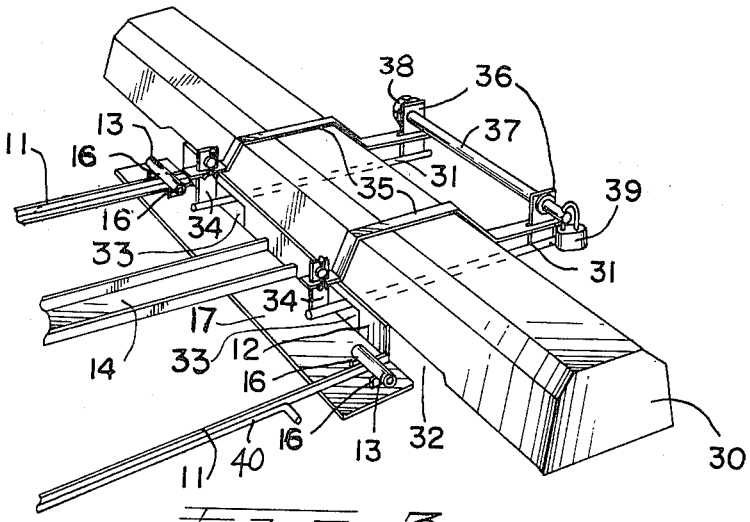
FIG. 3

ANTI-THEFT VEHICLE SHELTER

The automobile is a self contained vehicle that can be closed and locked to exclude the elements, thieves or vandals. It can thus be parked where convenient for long periods of time in adverse environment or conditions without much fear of damage from the elements or vandalism.

Smaller vehicles such as motorcycles, bicycles or snow mobiles however, are very vulnerable to the weather, thievery or pilfering. Even though padlocked they may be readily lifted into a truck and easily hauled away.

This invention provides a means whereby these smaller vehicles may be protected from human and environmental hazards, and parked in conventional parking space assigned to the owner of the vehicle adjacent apartment buildings or the like.

Referring now to the accompanying drawings wherein like reference characters indicate like parts.

FIG. 1 is a perspective view of a motorcycle within the device comprising the invention.

FIG. 2 is a perspective view of the device with the cover elevated in the process of being hingedly connected to the base of the device.

FIG. 3 is a perspective view of the forward portion of the base frame structure showing a method of securing the frame to a permanently fixed curbstone defining the limit of a parking space in a parking lot, adjacent an apartment building or the like.

FIG. 4 is an enlarged front view of the locking strap of a hinge for securing the cover to the base frame.

DESCRIPTION OF THE PREFERRED EMBODIMENT

Figure 5:
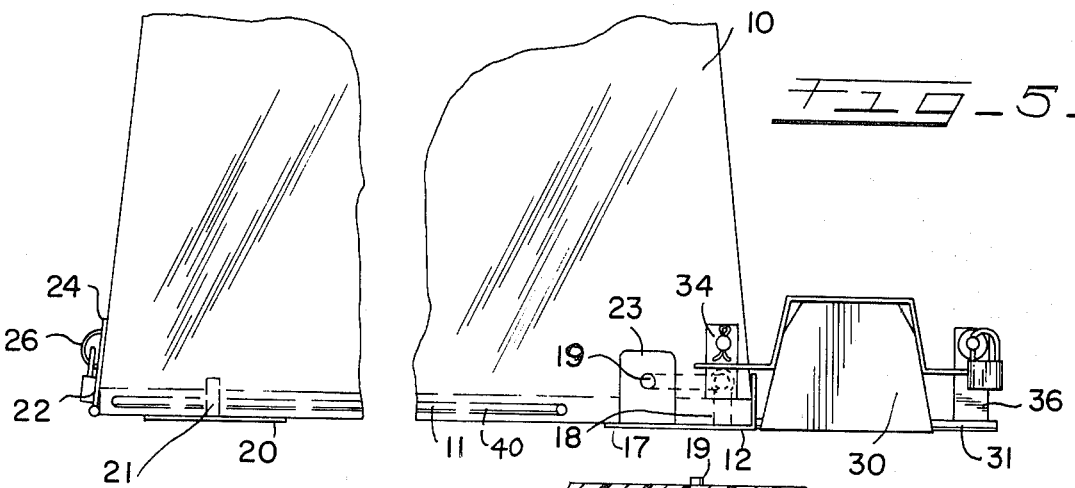
FIG. 5 is a side elevation of FIG. 1, partly broken away.

Referring now to the drawings in detail, the rigid plastic cover or pod is indicated at 10, and which is formed of suitable reinforced plastic, colored or not to suit. The cover has a rectangular base which is approximately 8 feet long, 3 feet wide and about 50 inches high. This is amply sufficient to cover and house most any motocycle or snow mobile now on the market.

Figure 6:
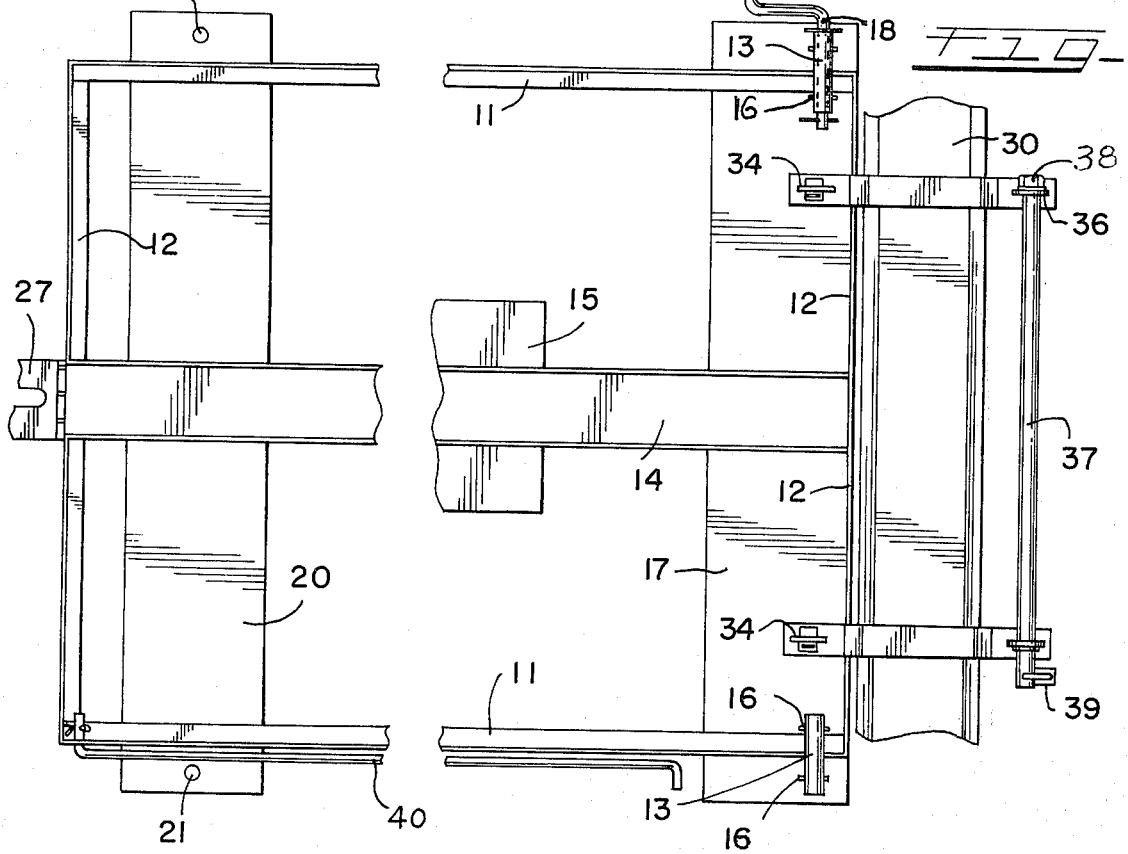
FIG. 6 is a top plan view of the frame structure on which the vehicle is placed before the plastic bubble or cover is placed thereon.
Figure 7:
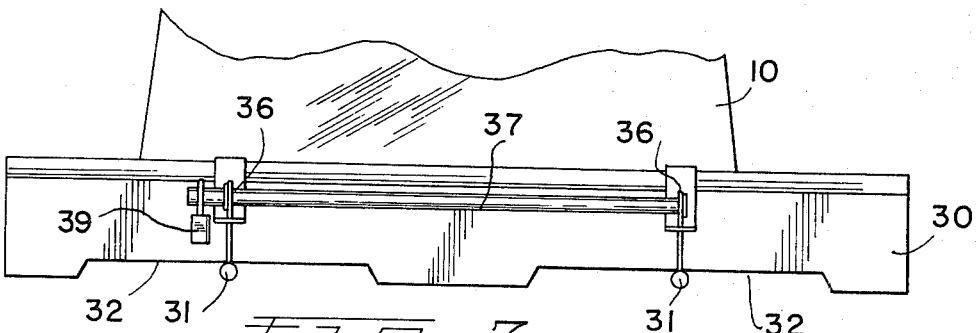
FIG. 7 is a front end view of FIG. 6, showing the cover thereon, but partly broken away.

To support the vehicle, there is provided a base frame as shown in FIGS. 2, 6 and 7, comprised of light gauge angle iron side bars 11—11, and end bars 12—12, mitered and welded together at the corners. This frame is provided with a pair of sleeves 13—13 at what will be termed the forward end of the frame. This frame is sized to coincide with the base of the cover, being designed to receive the cover whether a vehicle is on the frame or not. A 6 inch wide light gauge channel iron 14 is secured at the ends to the end channels 11—11 centrally thereof. Midway between the ends of the channel 11 is secured a rectangular plate 15 which serves as a drip pan. Channel 14 is a wheel guide for the wheels of the motorcycle and the plate 15 also functions as a base for a kick stand, supporting the vehicle in upright position as customary.

Sleeves 13, as best shown in FIG. 3, each comprise a short piece of pipe just long enough to span the side angles 11. Sleeves 13 are supported on a pair of bars 16 secured to the flat rectangular plate 17, installed under the ends of the side angle bars 11 and center channel 14 of the frame. The bars 16 support the sleeves so as to straddle the side angles. The sleeves act as bearings for one end 18 of a crank arm.

At the forward side margins of the cover, reinforcing plates 23—23 are provided each having axially aligned openings 24—24 through which the other ends 19 of the crank arm project when the cover is applied to the frame thereby providing pivot means whereby the cover may be tipped up on the axes of the sleeves 13—13 for removal or parking of the vehicle from or on the frame.

At the other end of the frame is another rectangular plate 20 which also extends under the side angles 11 and center channel 14, similar to the plate 17. Plate 20 is near the other end of the frame, and at each end margin of said plate 20 is an alignment pin 21 which extends upwardly normal to the plate 20, outside of the angles 11—11.

A reinforcing angle plate 22 is applied across the lower margin of the rear end of the closure 10 and the horizontal flange at the corners of which extend over the pins 21. A hole 28 is provided in the plate 22 located so that when the cover 10 is properly applied thereto said holes will line up with the pins 21 and properly locate the cover on the frame.

The angle plate 22 has a central upward extension 25 to which is applied the staple portion 26 of a hasp. The strap portion 27 of the hasp is mounted on the rear end of the central channel 14 so that the hinged axis of the hasp is approximately coincident with the end of the central channel 14.

Thus when the cover is on the frame the strap 27 may be raised over the staple 26 and a padlock applied to the staple to hold the cover secure to the frame.

In most parking lots adjacent apartment buildings, parking spaces for the tenants of the building are marked off for each tenant. These parking spaces are usually provided with a curbstone, such as indicated at 30, located at the end of a parking space to provide a stop for the auto vehicle being parked there.

To prevent theft of the cover or pod and frame, a locking system is provided as shown in FIG. 3. The curbstones are provided with a pair of grooves or channels 32 in the bottom surface thereof. A bar or rod 31 is provided to extend through the grooves 32 and also through openings 33 in the vertical flange of the end channels 12 of the frame. At the ends of each bar 31 is provided an upstanding bar 34. Bars 35 are provided to extend over the curbstone as shown in FIG. 3 and they are each provided with a slot at the end thereof to fit over the upstanding bars 34, after which a stub bolt 36 is placed through a hole in the bars 34 to hold the bars 35—35 securely in place. The other ends of the rods 31 are also provided with upstanding bars 36—36, the upper ends of which are provided with axially aligned openings in which is applied a rod 37 extending therethrough. A nut 38 is applied to one end of the rod 37 and the staple of a padlock 39 extends through a hole provided therefore in the other end of the rod. Since the bars 31 also extend through the openings 33 in the vertical flange of the end angles 12 of the frame, the frame is thus securely held to the curbstone.

To raise the cover or pod 10 up on pivot axis 13, the podlock on staple 26 is removed, the strap 27 of hasp is removed from the staple portion of the hasp, when the rear end of the closure may be raised upwardly, and the bracing rod 40 raised to support the cover in an inclined position while the vehicle is removed, or placed therein. The bracing rod 40 is bent at a right angle for short distance and is placed through an opening provided therefore in the side angle 11 as shown in FIG. 6. A cotter pin is applied through the end of the bent portion to retain it in place.

I claim:

1. A housing structure for motorcycles, snowmobiles or the like comrising in combination a rectangular base frame, a central channel, extending from end-to-end of said frame forming a wheel guide for a motorcycle or the like, a rectangular plate secured under said central channel providing a drip pan or base for a kickstand for a motorcycle or the like, a rigid plastic cover of a size to cover a vehicle on said frame, means, pivotally mounting one end of said cover to said frame, means locking the other end of said cover to said frame, means, comprising arms shaped and adapted to extend over and under a horizontally disposed curbstone or the like, and adapted to be removably secured thereto.

2. The structure of claim 1, said locking means comprising one part of a hasp secured to said other end of said cover, the other part of said hasp secured to said other end of said central channel in registry with said one part of said hasp.

* * * * *